United States Patent [19]

Ou

[11] 3,965,445

[45] June 22, 1976

[54] MICROSTRIP OR STRIPLINE COUPLED-TRANSMISSION-LINE IMPEDANCE TRANSFORMER

[75] Inventor: Wen-Pin Ou, Tempe, Ariz.

[73] Assignee: Motorola, Inc., Chicago, Ill.

[22] Filed: Feb. 3, 1975

[21] Appl. No.: 546,593

[52] U.S. Cl. ..... 333/33; 307/DIG. 1; 333/10; 333/35; 333/84 M

[51] Int. Cl.[2] ..... H01P 5/08

[58] Field of Search ..... 333/10, 33, 32, 35, 333/84 M; 307/299 R

[56] References Cited

UNITED STATES PATENTS

| | | | |
|---|---|---|---|
| 3,482,179 | 12/1969 | Webb | 333/32 X |
| 3,582,760 | 6/1971 | Sun | 333/84 M X |
| 3,668,552 | 6/1972 | Kuno et al. | 333/84 M X |

*Primary Examiner*—Paul L. Gensler
*Attorney, Agent, or Firm*—Michael D. Bingham; Harry M. Weiss

[57] ABSTRACT

An electrical transformer for transforming electrical impedances of high transformation ratios including a dielectric substrate having a pair of parallel electromagnetic coupled-transmission lines bonded to one surface of the dielectric substrate. The first of the pair of transmission lines being adapted to be connected to a first impedance at one end with the other end being connected to a ground terminal through a first tuning capacitance which varies the real part of the transformed impedance. The second of the pair of transmission lines being coupled, at its end opposite the first tuning capacitor, through a second tuning capacitance to a second impedance to which the first impedance is to be matched. The second tuning capacitance is utilized to vary the imaginary part of the transformed impedance.

13 Claims, 4 Drawing Figures

MICROSTRIP OR STRIPLINE COUPLED-TRANSMISSION-LINE IMPEDANCE TRANSFORMER

BACKGROUND OF THE INVENTION

This invention relates generally to transformers, and more particularly to radio frequency coupled-transmission-line impedance transformers.

There are many applications wherein it is desired to transform electrical impedances from one value to another. One such application is the matching of the input and output impedances of a microwave power device to a signal generating source and a load respectively.

Several techniques for providing impedance transformation at radio frequencies are known. The conventional approach used in microstrip and stripline matching of the low impedances of microwave power devices to respective input and output circuits involve the use of step transformers, such as described in "Microwave Filters, Impedance-Matching Networks and Coupling Structures" by Matthaei, Young and Jones, McGraw Hill Book Co., 1964. Other techniques include systems utilizing tuned transformers and toroidal ferrite transformers.

The technique of using stepped transformers often need transmission line sections with characteristic impedances of as low as one or two ohms. Thus, in microstrip or strip-line construction, such low characteristic impedances can only be realized with unreasonably wide lines that create discontinuities which are difficult to characterize. Also, the lack of convenient tuning schemes in such transformers often makes minor circuit adjustments difficult.

Whereas the latter techniques provide a way to match the input and output impedances of a microwave power device to its associated input and output circuitry, the use of tuned transformers is not suitable for wide band applications. The toroidal ferrite transformer used is expensive to manufacture and becomes inefficient at higher frequencies.

The need exists for coupled-transmission-line impedance transformers for high-ratio impedance transformations in microstrip or stripline without the ordinary difficulties encountered in conventional impedance-transformation schemes.

SUMMARY OF THE INVENTION

It is, therefore, an object of the present invention to provide an improved radio frequency transformer for transforming impedances from one level to another.

It is a further object of this invention to provide a coupled-transmission-line transformer for matching the input and output impedance of a microwave power device to its respective input and output circuitry.

It is another object of this invention to provide a coupled-transmission-line transformer using stripline transmission techniques.

A still further object of this invention is to provide a coupled-transmission-line transformer suitable for high-ratio impedance transformation in microstrip or stripline transmission techniques.

Yet another object of this invention is to provide a coupled-transmission-line transformer which has capacitive tuning elements for independently varying the real and imaginary part of the transformed impedance.

Still another object of this invention is to provide a coupled-transmission-line transformer in microstrip or strip-line transmission technique wherein the impedance levels of the coupled lines are maintained at a reasonable value for eliminating the necessity of using very wide lines.

In accordance with one embodiment of the invention, a layer of dielectric material has two metallic conductors deposited on one of its surfaces. The two conductors are spaced parallel and opposite each other by a predetermined distance to provide electromagnetic coupling therebetween. Connected to one end of the first of the pair of metal conductors is a capacitor which has its other terminal connected to ground. A second capacitor is attached to the end of the second conductor of the pair of conductors that is opposite the end of the first conductor to which the first capacitor has been attached. The other terminal of the second capacitor is then connected to an output circuit, which for example may be an input to a microwave power device. The unconnected end of the first conductor is then attached to an appropriate input circuit, which for example may be a signal generator which is to be connected to the aforementioneed microwave power device.

According to the invention the transformer may be tuned by varying the capacitors for varying the real and imaginary components thereof. In the disclosed embodiment, the impedance transformation ratio between the ports of the transformer may be greater than 30:1.

DETAILED DESCRIPTION OF THE EMBODIMENTS

Figure 1:
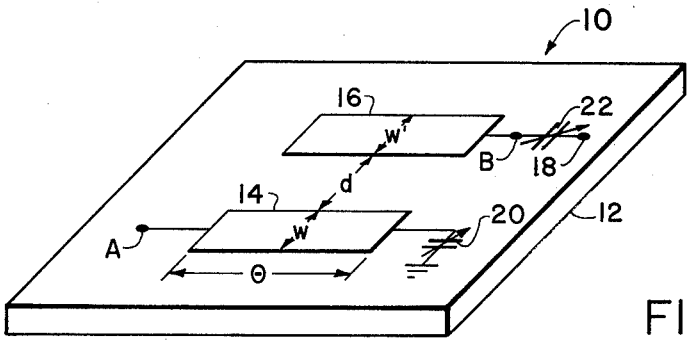
FIG. 1 is a diagram of the transformer of the embodiment of the invention.

Referring now to FIG. 1, there is shown a coupled-transmission-line impedance transformer 10 in accordance with the embodiment of the present invention. A substrate 12, made of a layer of dielectric material, is illustrated having first and second opposing planar surfaces. Deposited on one of the planar surfaces are a pair of coplanar coupled transmission line conductors 14 and 16 which are parallel and at a predetermined distance, $d$, to each other. The spacing, $d$, is such that electromagnetic coupling occurs therebetween to form a balanced transmission line. The length of transmission lines 14 and 16 is shown to be a predetermined electrical length, $\theta$. Although $\theta$ is not critical, by way of example, in the present invention a value of a quarter-wavelength in stripline at the midband frequency is utilized. The width of lines 14 and 16 is shown to be $w$ and $w'$ respectively. Port A of line 14 is adapted to be connected to a driving source that has a predetermined impedance which is to be matched to a predetermined impedance connected at terminal 18 of line 16. Connected to the opposite end of line 14 is a variable capacitor 20, the other terminal of which is returned to a point of reference potential such as ground. For the present application, substrate 12 may be a laminated structure such as Teflon fiberglass, for example, upon the surfaces of which are bonded layers of copper conducting material. Using known etching techniques, transmission conductors 14 and 16 are formed on one surface of substrate 12 with the opposing surface forming a ground plane. Port B of line 16 is adapted to be operatively connected in series with capacitor 22 to a load impedance of transformer 10.

In operation, heretobefore transformers used for matching a 50 ohm source to an input of a semiconductor power device have had several problems associated in the design thereof. Because semiconductor power transistors usually have very low input impedances, conventional microstrip or stipline transformers required transmission line sections having characteristic impedances of as low as one or two ohms. Such low characteristic impedances can only be realized with unreasonably wide lines which create discontinuities. Transformer 10 provides a novel solution to the aforementioned problem in the following manner.

If the length, $\theta$, is made to be 90° electrically, coupled lines 14 and 16 are equivalent to a quarter-wavelength transformer having an impedance equal to one-half of the quantity of the even-mode impedance minus the odd-mode impedance. The even- and odd-mode impedances of lines 14 and 16 are a function of the coupling factor therebetween. Therefore, by adjusting the width of lines 14 and 16, the spacing there between, the thickness of dielectric material 12 and the magnitude of the dielectric constant thereof, a proper choice of even and odd-mode impedances are realized for constructing a low impedance transformer in which the width of lines 14 and 16 do not create the aforementioned discontinuities. For flexibility of impedance adjustment, capacitors 20 and 22 are used for tuning the real and imaginary parts of the transformed impedance respectively.

The addition of tuning capacitors 20 and 22 provides a high degree of flexibility in the choice of the characteristic impedance of each of the lines 14 and 16 and the spacing, *d*, therebetween. It is appreciated that coupled lines 14 and 16 need not have the same width. The choice being determined by the desired transformation ratio, tuning range and circuit bandwidth.

What has been hereinbefore described is a coupled-transmission-line transformer using well known microstrip construction techniques. It should be obvious to one skilled in the art, that a similar transformer could be constructed using stripline techniques which are also known in the art.

Several advantages are attained by the above described embodiment of the invention over prior art transmission line impedance transformers. The characteristics of the coupled transmission lines of the subject invention are suitable for high-ratio impedance transformations without presenting discontinuities developed in conventional impedance transformers. Furthermore, a high degree of flexibility exists in the choice of the characteristic impedances of each line of the coupled-transmission-line transformer of the subject invention and the spacing therebetween to obtain the desired transformation. Moreover the coupled lines do not need to have the same width, which may be appreciated by one skilled in the art. Still further, with the spacing between coupled lines 14 and 16 being fixed, both the real and the imaginary part of the transformed impedance can be varied over a range of values by the use of variable capacitors.

Figure 2:
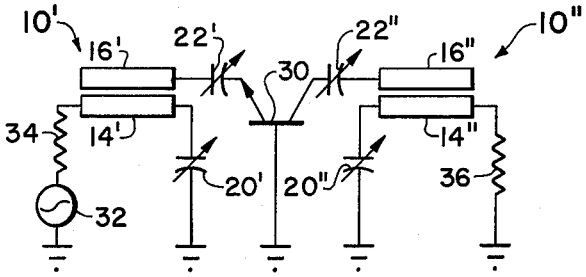
FIG. 2 is a diagram showing the transformer of the embodiment of the invention connected to a microwave power device.
Figure 3:
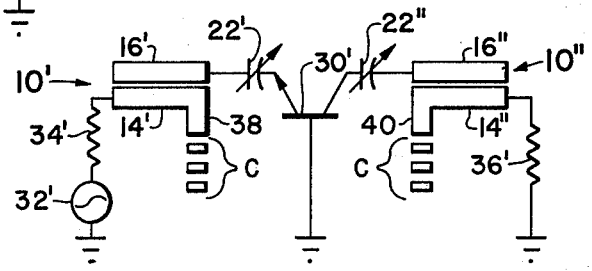
FIG. 3 is a diagram showing the transformer, slightly modified, of the embodiment of the invention as connected to a microwave power device.
Figure 4:
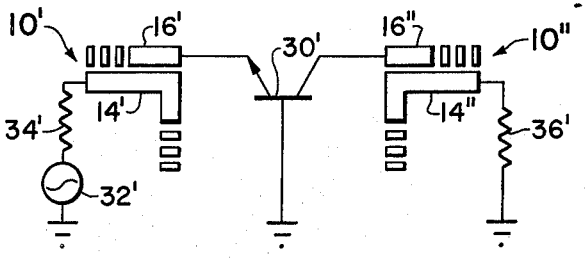
FIG. 4 is the transformer, having a further modification, of the embodiment of the invention as connected to a microwave power device.

FIGS. 2, 3 and 4 show several circuits wherein the transformer of FIG. 1 is used to match the input and output impedances of microwave power transistor 30 to driving source 32 and load 36. In FIGS. 2, 3 and 4 like components to those of FIG. 1 are noted by primed reference numerals.

In FIG. 2, driving source 32 which has an impedance 34, typically 50 ohms, is matched to the extremely low input impedance of transistor 30 by transformer 10′. The low output impedance of transistor 30 is matched to the circuit load impedance 36 by transformer 10″.

As discussed previously, tuning capacitors 20′ and 20″ provide for varying the real part of the transformed impedance so as to match the real part of the input and output impedance of transistor 30 to driving source 32, and load 36 respectively. Tuning capacitors 22′ and 22″ are used for varying the imaginary part of the transformer impedance.

FIG. 3 shows the transformer circuit of FIG. 2 wherein capacitors 20′ and 20″ have been replaced by transmission lines 38 and 40, respectively, each having a dimension less than a quarter-wavelength long. A plurality of conducting pads, C, each being insulated from one another, are provided for varying the effective capacitance of transmission lines 38 and 40 as is well understood in the art. Each individual conducting pad may be attached singly or in combination to respective transmission lines 38 and 40 by, for example, soldering a strip of conductive material between the transmission line and the particular pad or pads.

FIG. 4 shows the transformer circuit of FIG. 3 wherein capacitors 22′ and 22″ have been replaced in a similar manner as capacitors 20′ and 20″ of FIG. 2.

The transformer of the present invention provides a highly flexible method for achieving high-ratio impedance transformation without requiring coupled transmission lines having large width which introduce discontinuities. A high degree of flexibility exists in the choice of the characteristic impedance of each line and the spacing therebetween to obtain the desired impedance transformation. The transformer of the present invention may be used for matching a source and load impedance to a microwave power device. Moreover, the transformer provides a circuit wherein microwave power devices may be tested, as in a production test station, in which the input and output impedances of the transistors may vary over a range of values.

While the above detailed description has shown and described the fundamental novel features of the embodiments of the invention, it will be apparent to those skilled in the art that many changes and modifications may be made without departing from the spirit of the invention.

What is claim is:

1. A coupled-transmission-line impedance transformer for matching a first impedance to a second impedance utilizing a pair of parallel, electromagnetically coupled-transmission-lines disposed on a first surface of a dielectric substrate, and a ground plane disposed on a second surface of the dielectric substrate, comprising:

the first of said pair of transmission lines having first and second ends and a predetermined length and width, said first end being coupled to the first impedance;

first capacitive means coupled between said second end of the first transmission line and the ground plane for varying the effective electrical length of the first transmission line to vary the real part of the transformed impedance through the transformer;

the second of said pair of transmission lines having first and second ends and a predetermined length and width, said first end being open circuited and opposite said first end of the first transmission line; and second capacitive means for varying the effective electrical length of the second transmission line to vary the imaginary part of the transformed impedance through the transformer, said second capacitive means and said secod end of the second transmission line being connected in series to the second impedance.

2. The combination of claim 1 wherein: said first and second capacitive means includes variable tuning capacitors; and said second capacitive means is interposed between the second impedance and said second end of the second transmission line.

3. The transformer of claim 1, wherein:

said first capacitive means includes a third transmission line having a first end connected to said second end of the first transmission line, an open circuited end, and a plurality of metallic pads spaced from the open circuited end of said third transmission line in spatial relationship to each other;

said second capacitive means includes foreshortening of said open circuited end of the second transmission line and a plurality of metallic pads spaced from said foreshortened end, said plurality of metallic pads being in spatial relationship to each other, and said second end of the second transmission line being directly connected to the second impedance; and said plurality of metallic pads of said first and second capacitive means being connectable in any number thereof to said third transmission line and said foreshortened second transmission line respectively, said metallic pads being electromagnetically coupled to the ground plane such that said electrical length of the first and second transmission lines are varied accordingly to vary the real and imaginary parts of the transformed impedance through the transformer.

4. A microstrip coupled-transmission-line impedance transformer for matching a first impedance to a second impedance, comprising:

a layer of dielectric material having first and second surfaces;

a ground plane contiguous to said first surface of said dielectric material;

first conductive means disposed on said second surface said layer of dielectric material, one end of said first conductive means being coupled to the first impedance, said first conductive means having a predetermined length and width;

first capacitive means coupled in shunt between the other end of said first conductive means and said ground plane for varying the effective electrical length of said first conductive means to vary the real part of the transformed impedance, said first capacitive means including second conductive means having a predetermined length and width and a plurality of conductive pads, said pads being spaced from the open end of said second conductive means and insulated therefrom, said pads being attached to said dielectric material in series;

third conductive means disposed on said layer of dielectric material and electromagnetically coupled to said first conductive means, said third conductive means being spaced in parallel with and opposite to said first conductive means and having an open circuited end opposite to said one end of said first conductive means and a second end, said second end being connected to the second impedance;

second capacitive means for varying the effective electrical length of said second conductive means to vary the imaginary part of the transformer impedance, said second capacitive means, including a plurality of conductive pads spaced from said open circuited end of said third conductive means and insulated therefrom, said pads being attached to said second surface of said dielectric material in a series; and a predetermined number of each of said plurality of conductive pads of said first and second capacitive means, respectively, are connectable to said second conductive means and said open circuited end of said third conductive means respectively.

5. A microstrip, coupled-transmission-line impedance transformer for matching a first impedance to a second impedance, comprising:

a layer of dielectric material having first and second planar surfaces;

a ground plane contiguous to said first surface of said dielectric material;

a first transmission line having a predetermined length and width disposed on said second surface of said dielectric material, a first end of said first transmission line being coupled to the first impedance;

first variable capacitive means connected in shunt between a second end of said first transmission line and said ground plane for varying the effective electrical length of said first transmission line to vary the real part of the transformed impedance through the transformer;

a second transmission line disposed on said second surface of said layer of dielectric material having a predetermined length and width, said second transmission line being spaced substantially parallel to said first transmission line and being electromagnetically coupled thereto, said second transmission line having a first end thereof which is directly opposite said first end of said first transmission line terminated in an open circuit; and second variable capacitive means connected between the other end of said second transmission line and the second impedance for varying the effective electrical length thereof to vary the imaginary part of the transformed impedance through the transformer.

6. The transformer of claim 5 wherein said predetermined lengths of said first and second transmission lines are substantially 90 electrical degrees.

7. A transformer circuit including an input and an output transformer suitable for matching the input and output impedance of a microwave power transistor to a signal source and to a transistor load respectively, comprising:

a layer of dielectric material having first and second opposing planar surfaces;

a ground plane contiguous to said second surface of said dielectric material;

the input transformer including:

a. first electrically conductive means disposed on said first surface of said dielectric material and having a predtermined length and width, said first electrically conductive means being coupled at one end thereof to the signal source;

b. second electrically conductive means having a predetermined length and width and being electromagnetically coupled to and spaced substantially parallel to said first electrically conductive means;

c. first capacitive means for varying the effective length of said first electrically conducting means to vary the real part of the transformed impedance through the input transformer, said first capacitive means being coupled between the other end of said first electrically conductive means and said ground plane;

d. second capacitive means for varying the effective electrical length of said second electrically conductive means to vary the imaginary part of the transformed impedance through the input transformer, said second electrically conductive means and said second capacitive means being connected in series to the transistor input electrode; and e. said first and second capacitive means cooperating with each other to match the real and imaginary parts of the impedance of the signal source to the real and imaginary parts of the input impedance of the transistor to couple maximum energy to the transistor.

8. The transformer circuit of claim 7 wherein the output transformer includes:

third electrically conductive means disposed on said first surface of said dielectric material and having a predetermined length and width;

fourth electrically conductive means disposed on said first surface of said dielectric material and having a predetermined length and width and being electromagnetically coupled to said third electrically conductive means, said fourth conductive means being spaced from and substantially parallel to said third conductive means with one end of said fourth electrically conductive means being coupled to the transistor load impedance;

third capacitive means for varying the effective electrical length of said third electrically conductive means to vary the imaginary part of the transformed impedance through the output transformer, said third capacitive means and said third electrically conductive means being connected in series to the output electrode of the transistor;

fourth capacitive means for varying the effective electrical length of said fourth electrically conductive means to vary the real part of the transformed impedance through said output transformer, said fourth capacitive means being coupled between the other end of said fourth electrically conductive means and said ground plane; and said third and fourth capacitive means cooperating with each other to match the real and imaginary parts of the output impedance of the transistor to the real and imaginary parts of said transistor load impedance to couple maximum energy thereto.

9. The transformer circuit of claim 8 wherein:

said first, second, third and fourth capacitive means include variable tuning capacitors;

said second capacitive means is interposed between the end of said second electrically conductive means which is opposite said first capacitive means and said input electrode of the transistor; and said third capacitive means being interposed between said output electrode of the transistor and the end of said third electrically conductive means which is opposite said fourth capacitive means.

10. The transformer circuit of claim 8 wherein:

said first capacitive means includes a first additional electrically conductive means disposed on said first surface of said dielectric material, said first capacitive means being connected to said other end of said first conductive means and having a predetermined width and length;

said fourth capacitive means includes a second additional electrically conductive means disposed on said first surface of said dielectric material, said fourth capacitive means being connected to said other end of said fourth conductive means and having a predetermined length and width; and said first and fourth capacitive means each including a plurality of pads disposed on said first surface of said dielectric material, said pads being disposed at the open ends of said first and second additional conductive means in series.

11. The transformer circuit of claim 10 wherein a predetermined number of said plurality of pads of each of said first and fourth capacitive means are connectable to said first and second additional capacitive means respectively for varying the effective electrical length of said first and second additional conductive means.

12. The transformer circuit of claim 10 wherein:

said second electrically conductive means is directly connected at one end thereof to said input electrode of the transistor; said one end being opposite said first capacitive means, the other end of said second conductive means being foreshortened by a predetermined length and terminating in an open current;

said second capacitive means includes a plurality of conductive pads disposed on said first surface of said dielectric material, said pads being disposed at said open circuited end of said second foreshortened electrically conductive means in series;

said third electrically conductive means is directly connected at one end thereof to said output electrode of the transistor, said one end being opposite said fourth capacitive means, the other end of said third conductive means being foreshortened by a predetermined length and terminating in an open circuit; and said third capacitive means includes a plurality of conductive pads disposed on said first surface of said dielectric material, said pads being disposed at said open end of said third foreshortened electrically conductive means in series.

13. The transformer circuit of claim 12, wherein a predetermined number of said plurality of conductive pads of said second and third capacitive means are connectable to said second and third foreshortened conductive means respectively, for varying the respective effective electrical length thereof.

* * * * *